US006469630B1

(12) United States Patent
Jeske et al.

(10) Patent No.: US 6,469,630 B1
(45) Date of Patent: Oct. 22, 2002

(54) SYSTEM AND METHOD FOR DETERMINING THE ENVIRONMENTAL CONFIGURATION OF TELECOMMUNICATIONS EQUIPMENT

(75) Inventors: Richard Jeske, Georgetown; Patrick E. Jackson; Yen Teresa Nguyen, both of Austin, all of TX (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 09/939,088

(22) Filed: Aug. 24, 2001

(51) Int. Cl.[7] ..... G08B 21/00

(52) U.S. Cl. ..... 340/635; 340/3.43; 340/825.36; 370/254

(58) Field of Search ..... 340/3.43, 7.29, 340/7.3, 635; 370/242, 254; 375/228; 379/39

(56) References Cited

U.S. PATENT DOCUMENTS 4,750,136 A * 6/1988 Arpin et al. ..... 364/514
5,796,933 A * 8/1998 Aitoniemi ..... 395/180
6,012,152 A * 1/2000 Douik et al. ..... 714/26
6,359,565 B1 * 3/2000 Pedoeem et al. ..... 340/584

* cited by examiner

*Primary Examiner*—Daniel J. Wu
*Assistant Examiner*—Phung Nguyen
(74) *Attorney, Agent, or Firm*—Baker Botts L.L.P.

(57) ABSTRACT

A system and method determines the environmental configuration of telecommunications equipment having interchangeable components to provide an alarm if an improper environmental configuration exists. A configuration engine associated with the network management system of the telecommunications equipment determines the environmental rating of components added to or removed from the telecommunications equipment by querying flash memory associated with the component. If components designed for controlled environmental conditions and components designed for uncontrolled environmental conditions are both present in the telecommunications equipment, then component engine 30 sets the alarm to alert the user of an improper environmental configuration.

17 Claims, 1 Drawing Sheet

SYSTEM AND METHOD FOR DETERMINING THE ENVIRONMENTAL CONFIGURATION OF TELECOMMUNICATIONS EQUIPMENT

TECHNICAL FIELD

This invention relates generally to telecommunications equipment, and more specifically relates to a system and method for determining the environmental configuration of telecommunications equipment.

BACKGROUND OF THE INVENTION

Telecommunications equipment is deployed and operates in many different environmental conditions, such as various temperature ranges and in the presence of different types and quantities of contaminants. Telecommunications equipment is typically classified according to the type of environmental conditions that the equipment is designed to handle. One common classification is a classification for commercial environments that maintain controlled environmental conditions, such as narrow temperature ranges and reduced presence of contaminants. Telecommunications equipment having a commercial classification is thus generally installed and operated in controlled environmental conditions, such as temperature controlled central office facilities. Another common classification for telecommunications equipment is operation in an industrial environment. Equipment designed to operate in an industrial environment, typically faces uncontrolled environmental conditions such as the outdoor temperature ranges experienced in the geographic location at which the telecommunications equipment is deployed. For instance, a digital subscriber line access multiplexer deployed at a digital loop carrier may experience extremely high summer time temperatures and extremely low winter temperatures.

Although telecommunications equipment having uncontrolled or outside plant classifications is generally less likely to fail due to extreme environmental conditions, such equipment is also typically much more expensive to manufacture. Due to this cost difference, telecommunications equipment used in both controlled and uncontrolled environments is normally manufactured and sold as different systems even if they perform similar functions. For example, digital subscriber line access multiplexers (DSLAM) are deployed both in controlled central office environments and uncontrolled distributed locations so that customer end points are able to interface with the central office through digital subscriber line (DSL) connections. DSLAMs are typically designed as modular systems with interchangeable components to provide scalable service. To reduce the cost and complexity of stocking the components, some of the less complex components are used in both DSLAMs having controlled and uncontrolled environmental ratings. For instance, a chassis backplane is an interchangeable component that offers little cost savings if designed separately for controlled and uncontrolled environments and is thus typically a component designed in a singular manner for use in both environments.

One difficulty with the use of interchangeable components that have controlled, uncontrolled and both environmental ratings is that telecommunications equipment may be deployed with improper environmental configurations. For instance, a component having an uncontrolled rating is generally more expensive than a component having a controlled rating so that the use of components having an uncontrolled environmental rating in telecommunications equipment deployed in a controlled environment creates an unnecessary expense. Further, the use of components having a controlled environmental rating in telecommunications equipment deployed in an uncontrolled environment may result in premature failure of the equipment and interruptions in telecommunications service. Detecting an improper environmental configuration is especially difficult when some of the interchangeable components are designed for use in both controlled and uncontrolled environments.

SUMMARY OF THE INVENTION

Therefore a need has arisen for a system and method which determines whether telecommunications equipment is configured or manufactured with a proper environmental configuration.

A further need has arisen for a system and method which determines the compatibility of components inserted in a modular telecommunications system with the anticipated environmental conditions in which the telecommunications system will operate.

In accordance with the present invention, a system and method is provided that substantially eliminates disadvantages and problems associated with previously developed systems and methods for determining the environmental configuration of telecommunications equipment. A component engine associated with the telecommunications equipment determines the environmental rating of components added to or removed from the equipment and sets an alarm if an improper environmental configuration exists.

More specifically, the telecommunications equipment accepts plural modular and interchangeable components that perform telecommunications functions. For instance, a DSLAM has a chassis backplane with slots to accept modular components such as daughter boards, line cards, network cards and optical interfaces. The components have flash memory that stores an environmental rating, such a controlled environmental rating or an uncontrolled environmental rating. Components with a controlled environmental rating are designed to operate in controlled environmental conditions such as a central office, and components with an uncontrolled environmental rating are designed to operate in uncontrolled environmental conditions such as the outdoors. Components that do not store an environmental rating are assigned a rating of both uncontrolled and controlled that is acceptable for use in both uncontrolled and controlled environmental conditions.

The component engine reads the environmental rating from the flash memory. If a component lacks flash memory or does not have a rating stored in its flash memory, then the component engine assigns a "both" rating to those components that do not store a rating. As components are added to or removed from the DSLAM, the component engine maintains a list of components and their ratings in list memory that is associated with the DSLAM's network management system. Alternatively, the flash memory stores the temperature ranges of a component and the component engine uses this information to determine the component's temperature rating. In this embodiment, the component engine may track the overall temperature range of the system, resulting in an operating temperature range output for the telecommunications equipment.

An alarm is set to indicate an improper environmental configuration if the list memory includes at least one component having a controlled rating and one component having an uncontrolled rating. An alarm interface provides feedback to technicians so that a technician is able to identify the environmental rating of the components. If a component is removed from the DSLAM resulting in resolution of the alarm condition, such as a component with a controlled rating is removed leaving only components with uncontrolled and both ratings, then the alarm clears. In one embodiment, the telecommunications equipment is preconfigured with at least one component of a desired rating so that the component engine is able to check added components against the preconfigured rating and set an alarm if a component with a different,rating is added.

The present invention provides a number of important technical advantages. One example of an important technical advantage is that the alarm provides automated warning at field locations if a technician creates an improper environmental configuration by changing the components within telecommunications equipment. The alarm reduces the risk of telecommunications equipment failure that might otherwise result if, for instance, a component having a controlled rating is mistakenly used in an uncontrolled environment. The alarm also reduces the risk that more expensive components designed for uncontrolled environments will be used in controlled environments, unnecessarily increasing the cost of the telecommunications equipment.

Another example of an important technical advantage of the present invention is that telecommunications equipment designed only for either a controlled or an uncontrolled environment is more easily converted to selectively operate in both environments by replacing selected components with interchangeable components having a desired environmental rating. For instance, telecommunications equipment designed to operate in a controlled central office environment may be upgraded to operate in uncontrolled outdoors environments by exchanging modules likely to fail in uncontrolled environments with interchangeable modules rated to operate in uncontrolled environments. The component engine is uploaded to operate on the network management system of the telecommunications equipment with minimal expense and complexity to substantially reduce the risk that the interchangeable components will be incorrectly loaded onto the telecommunications equipment.

BRIEF DESCRIPTION OF THE DRAWINGS

A more complete understanding of the present invention and advantages thereof may be acquired by referring to the following description taken in conjunction with the accompanying drawings, in which like reference numbers indicate like features, and wherein.

DETAILED DESCRIPTION OF THE INVENTION

Preferred embodiments of the present invention are illustrated in the figures, like numerals being used to refer to like and corresponding parts of the various drawings.

On a per-component basis, the cost savings of an uncontrolled environment rating for a component over its controlled environment component equivalent may or may not be significant enough to justify the separate design, manufacturing and inventory costs of maintaining different components. If the cost savings is not substantial enough to justify the interchangeable components with different ratings, then the component is designed to operate in both environments, typically by achieving the more stringent uncontrolled environmental rating. If the cost savings is substantial enough to justify interchangeable components with different environmental ratings then a component having a controlled rating is separately designed, manufactured and stocked from an interchangeable component having an uncontrolled rating.

Components having the uncontrolled rating are typically more expensive and thus is typically used in telecommunications equipment deployed in uncontrolled environmental conditions, such as the outdoors. In contrast, components having a controlled rating will typically fail if deployed in uncontrolled environmental conditions. For example, a chassis backplane is generally a less expensive component easily adapted for use in both controlled and uncontrolled environmental conditions. However, components that include many logical devices, such as motherboards and network cards, generally have a substantial cost associated with designs for uncontrolled environmental conditions compared with designs for controlled environmental conditions. Thus, it is generally economical to maintain and use these types of components as having separate environmental ratings.

In order to achieve the cost savings of having interchangeable components with controlled and uncontrolled ratings, the components must be compatible with common components that are rated for both controlled and uncontrolled environments. Thus, detection of improper environmental configurations presents a problem, especially if common component reference points, such as the chassis backplane are rated for both controlled and uncontrolled environmental conditions. For instance, if the chassis backplane is rated for both controlled and uncontrolled environmental conditions, then the addition of a controlled component or an uncontrolled component will not result in an improper environmental configuration unless both are added to the system.

Figure 1:
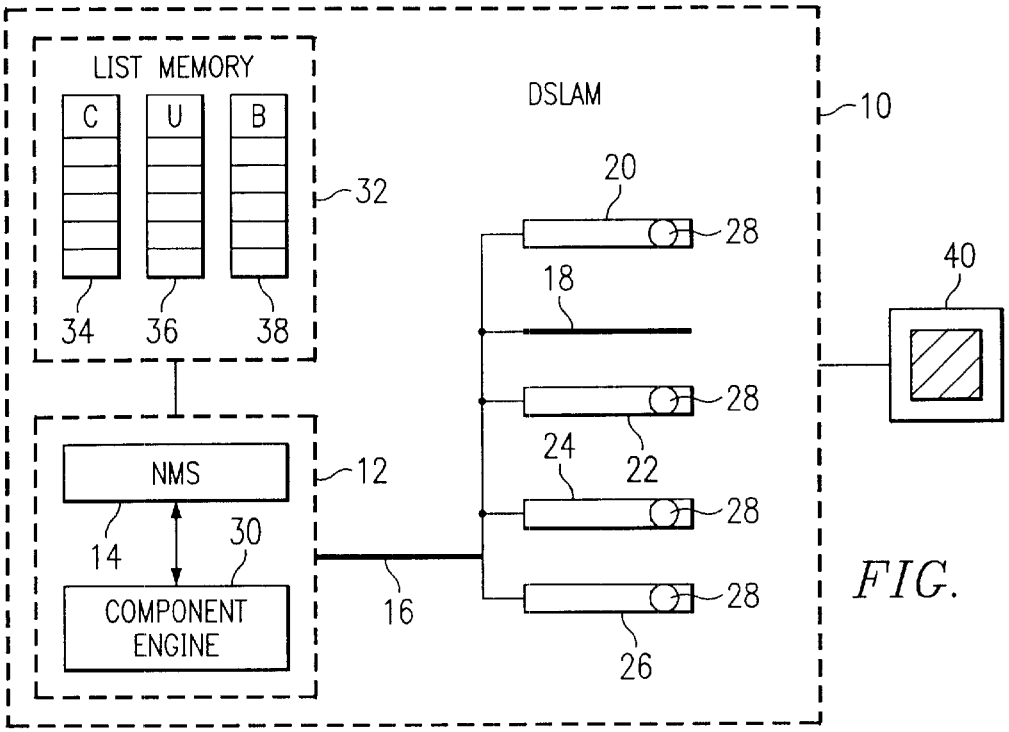
FIG. 1 depicts a block diagram of a DSLAM configured to detect its environmental configuration.

Referring now to FIG. 1, a block diagram depicts telecommunications equipment having interchangeable components that operate in controlled or uncontrolled environments. One example of such telecommunications equipment is a DSLAM which is often designed for use in both central office locations and distributed outdoor locations. DSLAM 10 includes a motherboard 12 that has hardware and software to support a network management system 14 which interfaces with components through a backplane bus 16. Backplane bus 16 is typically a relatively simple component that is rated for both controlled and uncontrolled environments. Motherboard 12 generally includes logical units that are sensitive to environmental conditions so that motherboard 12 generally has either a controlled rating or an uncontrolled rating. Network management system 14 however is typically driven by software components compatible with motherboards having either a controlled or uncontrolled rating. In alternative embodiments, components may be configured in a number of ways, such as integrating components like the optical interface and network interface with the motherboard. The system of FIG. 1 is an example for illustrative purposes.

Backplane bus 16 provides an interface between motherboard 12 and plural slots 18. Slots 18 accept cards that communicate with motherboard 12 to provide telecommunications functions. For instance, a daughterboard card 20 provides additional logic, a line card 22 provides an external interface for DSL connections, a network card 24 coordinates network activity, and an optical interface card 26 provides an optical interface to other networks, such as an OC3 connection to a regional operating center. The cards inserted in slots 18 cooperate with motherboard 12 and network management system 14 to provide telecommunications services between DSL end users and other locations, such as the internet. It should be understood that, although the present invention is described with respect to a DSLAM, other telecommunications equipment with similar architectures use interchangeable components having different environmental ratings and that such telecommunications equipment falls within the scope of the present invention.

A component engine 30 associated with motherboard 12 and interfaced with network management system 14 determines the environmental rating of components associated with DSLAM 10 by reading each component's rating from flash memory such as EEPROM 28 associated with each component. For instance, when a line card 22 is added to DSLAM 10, component engine 30 queries the EEPROM 28 associated with line card 22 to determine if the line card has a controlled rating or an uncontrolled rating. If the rating in the EEPROM 28 is controlled, then component engine 30 cooperates with network management system 14 to add the line card to list memory 32 in the controlled list 34. If line card 22 has an uncontrolled rating, component engine 30 adds the line card to the list memory 32 in the uncontrolled component list 36. If no rating is stored in the EEPROM 28, or no EEPROM 28 is found, then component engine 30 includes line card 22 in the both list 38 of list memory 32. As components are removed from DSLAM 10, component engine 30 removes the component from its appropriate list of list memory 32. In one alternative embodiment, both list 38 is not separately maintained so that components not found on controlled list 34 and uncontrolled list 36 are assumed to have a both rating.

When a component is added or removed from DSLAM 10, component engine 30 compares the components in list memory 32 to determine if an improper environmental configuration exists. For instance, if DSLAM 10 includes a component with a controlled environmental rating and a component with an uncontrolled environmental rating, then an improper environmental configuration exists. If an improper environmental configuration exists, component engine 30 sends network management system 14 an error message and outputs an alarm to alarm interface 40. A technician may use alarm interface 40 to query the identity and rating of the interchangeable components to isolate and correct the improper environmental configuration.

Figure 2:
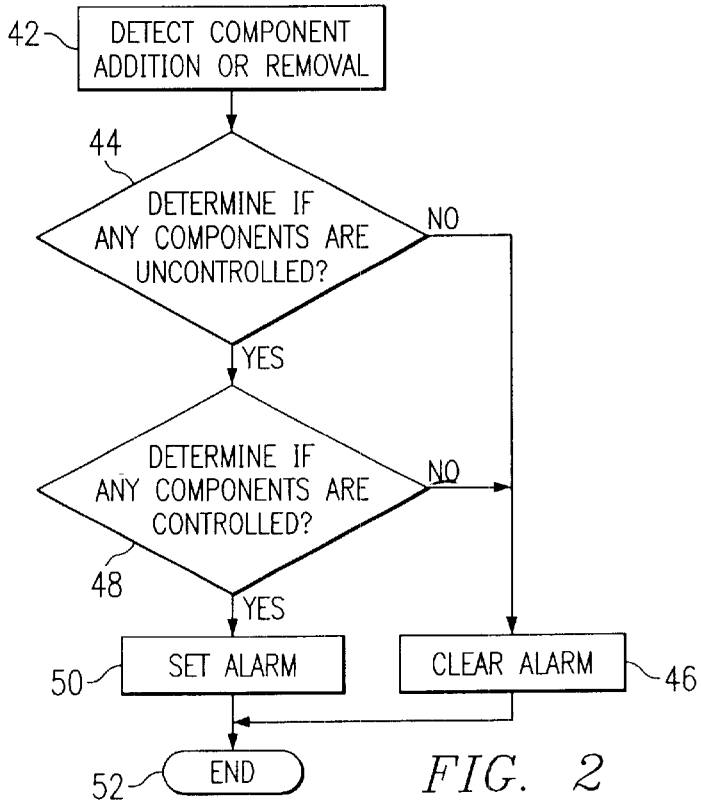
FIG. 2 depicts a flow diagram of steps for determining the environmental configuration of telecommunications equipment.

Referring now to FIG. 2, a flow diagram depicts the steps taken by component engine 30 to determine the environmental configuration of DSLAM 10. At step 42, component engine 30 detects the addition to or removal from DSLAM 10 of interchangeable components. For instance, if a card is inserted into slot 18, component engine 30 queries the card's flash memory to determine the environmental rating of the card and add the card to the appropriate list of list memory 32. If a card is removed from slot 18, component engine 30 removes the card's identity from list memory 32.

At step 44, component engine 30 determines if any components have an uncontrolled environmental rating. This determination is a query to list memory 32 for components listed in uncontrolled list 36. If no components are listed in uncontrolled list 36 then component engine 30 clears any alarms at step 46. If components are listed in uncontrolled list 36, then component engine 30 proceeds to step 48 to determine if any components are controlled. If any components are controlled then an improper environmental configuration exists and the alarm is set at step 50. If no components are controlled at step 48, then the alarm is cleared at step 46 and the process ends at step 52.

Component engine 30 represents a relatively simple software module that is easily interfaced with network management system 14. Thus, existing systems that are configured solely either for controlled or uncontrolled environments are easily upgraded to adapt into systems that accept interchangeable components with different environmental ratings by upgrading the network management system with a component engine.

Although the present invention has been described in detail, it should be understood that various changes, substitutions and alterations can be made hereto without departing from the spirit and scope of the invention as defined by the appending claims.

What is claimed is:

1. A method for determining the environmental configuration of telecommunications equipment having interchangeable components, the method comprising:

configuring the telecommunications equipment with plural components, each component having one of a controlled rating if the component is for use in a controlled environment, an uncontrolled rating if the component is for use in an uncontrolled environment or a both rating if the component is for use in both a controlled environment or an uncontrolled environment;

storing a component rating for one or more components in memory associated with the component;

detecting the rating for each component added or deleted to the telecommunications equipment;

determining that an improper environmental configuration exists if one or more components has a controlled environment rating and one or more components has an uncontrolled environment rating;

setting an alarm if the improper environmental configuration condition exists; and clearing the alarm if an improper environmental configuration does not exist.

2. The method of claim 1 wherein storing a component rating further comprises storing a rating for each component in flash memory associated with the component.

3. The method of claim 2 wherein the flash memory comprises EEPROM.

4. The method of claim 1 wherein detecting the rating further comprises:

determining whether an added component has a controlled environment or uncontrolled environment rating stored in memory associated with the component; and assigning a both rating to components that do not have a rating stored in memory associated with the component.

5. The method of claim 4 wherein detecting the rating further comprises:

storing the rating for each component added to the telecommunications equipment in memory associated with the telecommunications equipment; and deleting the rating for each component removed from the telecommunications equipment from the memory associated with the telecommunications equipment.

6. The method of claim 1 wherein the telecommunications equipment comprises a digital subscriber line access multiplexer.

7. The method of claim 6 wherein the digital subscriber line access multiplexer comprises a chassis backplane having a both rating.

8. The method of claim 1 wherein the controlled environment comprises a central office.

9. The method of claim 1 wherein the uncontrolled environment comprises an outdoors environment.

10. The method of claim 1 wherein the ratings are associated with capability for operations in predetermined temperature environments.

11. A telecommunications system comprising:

plural interchangeable components, each component having a controlled rating if the component is for use in a controlled environment, an uncontrolled rating if the component is for use in an uncontrolled environment or a both rating if the component is for use in both a controlled environment or an uncontrolled environment;

a component engine operable to determine the rating of each component;

a network management system interfaced with the component engine, the network management system tracking the rating of each component; and an alarm interfaced with the network management system, the alarm operable to provide notice of an improper environmental configuration if the network management system detects a component having a controlled environment rating and a component having an uncontrolled environment rating.

12. The system of claim 11 wherein the plural interchangable components comprise a backplane bus having a rating of both controlled and uncontrolled.

13. The system of claim 11 wherein the plural interchangable components comprise digital subscriber line cards having one of a controlled rating or an uncontrolled rating.

14. The system of claim 11 wherein the interchangable components comprise optical interface cards having one of a controlled rating or an uncontrolled rating.

15. The system of claim 11 further comprising list memory associated with the component engine and the network management system, the list memory tracking the environmental rating of interchangeable components interfaced with the telecommunications system.

16. The system of claim 11 further comprising flash memory associated with at least some of the interchangeable components, the flash memory storing the environmental rating of its associated component.

17. The system of claim 16 wherein at least some of the components having a both environmental rating lack flash memory, the component engine assigning a both rating when no rating is stored on the component.

* * * * *